US011686062B1

(12) United States Patent
Ayadat et al.

(10) Patent No.: US 11,686,062 B1
(45) **Date of Patent: *Jun. 27, 2023**

(54) GEOFABRIC-CONTAINING FOUNDATION SYSTEM

(71) Applicant: Prince Mohammad Bin Fahd University, Dhahran (SA)

(72) Inventors: Tahar Ayadat, Dhahran (SA); Danish Ahmed, Dhahran (SA)

(73) Assignee: Prince Mohammad Bin Fahd University, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/968,918

(22) Filed: Oct. 19, 2022

Related U.S. Application Data

(63) Continuation of application No. 17/840,205, filed on Jun. 14, 2022.

(51) Int. Cl.
*E02D 27/34* (2006.01)

(52) U.S. Cl.
CPC ..... *E02D 27/34* (2013.01); *E02D 2200/1685* (2013.01); *E02D 2300/001* (2013.01); *E02D 2300/002* (2013.01); *E02D 2300/0009* (2013.01); *E02D 2300/0034* (2013.01); *E02D 2300/0079* (2013.01); *E02D 2300/0089* (2013.01)

(58) Field of Classification Search
CPC ..... E02D 27/34; E02D 3/08
See application file for complete search history.

(56) References Cited

U.S. PATENT DOCUMENTS 6,672,015 B2 1/2004 Cognon

FOREIGN PATENT DOCUMENTS

CN 207934028 U 10/2018
CN 110512637 * 11/2019
CN 111648348 A 9/2020

OTHER PUBLICATIONS

Samanta, et al. ; 3D numerical analysis of piled raft foundation in stone column improved soft soil; International Journal of Geotechnical Engineering, 2017 ; Aug. 9, 2017 ; 11 Pages.

(Continued)

*Primary Examiner* — Carib A Oquendo
(74) *Attorney, Agent, or Firm* — Oblon, McClelland, Maier & Neustadt, L.L.P.

(57) ABSTRACT

The foundation system includes a below ground rigid raft foundation to bear a load for an above ground structure, and granular cushions and piles formed below the raft foundation. The granular cushions are configured for uniform load distribution of the raft foundation and the piles are configured to bear a load of the above ground structure and the raft foundation. The foundation system further includes stone columns encapsulated with a non-woven geofabric and configured to stabilize the raft foundation. The raft foundation is disposed adjacent and above the stone columns, the granular cushions are present between neighboring stone columns, and the granular cushions are present between the stone columns and the piles. The stone columns have a cementing agent for stabilization.

16 Claims, 3 Drawing Sheets

(56) References Cited

OTHER PUBLICATIONS

Ahmed, et al. ; A Review on the Behaviour of Combined Stone Columns and Pile Foundations in Soft Soils when Placed under Rigid Raft Foundation ; ASM Science Journal, vol. 16 ; 2021 ; 8 Pages.
Sharma, et al. ; Behaviour of Raft Foundation Supported by Stone Columns and Combination with Rigid Piles in Soft Clay Soils: 3D Numerical Study ; International Research Journal of Engineering and Technology vol. 8, Issue 9 ; Sep. 2021; 9 Pages.
El Kamash, et al. ; Optimizing the Unconnected Piled Raft Foundation for Soft Clay Soils: Numerical Study ; KSCE Journal of Civil Engineering, 24(4) ; Mar. 9, 2020 ; 8 Pages.
Ayadat, et al. ; Encapsulated stone columns as a soil improvement technique for collapsible soil; Ground Improvement 9, No. 4; pp. 137-147; 2005; 11 Pages.
Ayadat ; Geotechnical Performance of Encapsulated and Stabilized Stone Columns in a Collapsible Soil; Int. J. Geomech, 22(6) ; 2022 ; 12 Pages.

* cited by examiner

GEOFABRIC-CONTAINING FOUNDATION SYSTEM

CROSS-REFERENCE TO RELATED APPLICATIONS

The present application is a Continuation of U.S. application Ser. No. 17/840,205, pending, having a filing date of Jun. 14, 2022.

BACKGROUND

Technical Field

The present disclosure is directed to a foundation system for various ground structures, and particularly, to a foundation system for collapsible soils.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Generally, foundations connect above ground portion of a structure with ground such that a load of the above ground portion is evenly distributed to the ground. A foundation can be a shallow foundation or a deep foundation depending on strength of soil, type of buildings, and size of buildings. Foundation engineers have encountered problems developing a new foundation system for collapsible soils. Collapsible soils possess considerable in-situ dry strength that is largely lost when the soils become wetted. Further, the amount and type of treatment required for such soils depends on the depth of the collapsible soils and support required for the proposed structure. In many cases, deep foundations are considered to transmit foundation loads to suitable bearing strata below the collapsible soil deposit. However, developing a foundation design for such collapsible soils is a tedious task. Therefore, there is a need remains to develop a foundation system that is cost effective and capable of absorbing tensile and lateral loads.

SUMMARY

In an exemplary embodiment, a foundation system for collapsible soils is described. The foundation system includes a below-ground rigid raft foundation to bear a load for an above-ground structure. A plurality of granular cushions formed below the below-ground rigid raft foundation and the granular cushions are configured for uniform load distribution of the below-ground rigid raft foundation. A plurality of piles is formed below the raft foundation and is configured to bear a load of the above-ground structure and the below-ground rigid raft foundation. A plurality of below-ground stone columns is configured to stabilize the below-ground rigid raft foundation and the below-ground stone columns are encapsulated with a non-woven geofabric. The below-ground raft foundation is adjacent and above the below-ground stone columns, the granular cushions are present between neighboring below-ground stone columns, and the granular cushions are present between the below-ground stone columns and the piles. The below-ground stone columns have a cementing agent for stabilization.

In some embodiments, the piles are steel and cylindrical in shape and the piles are filled with a concrete.

In some embodiments, the piles are coated with an epoxy.

In some embodiments, the piles have a length of from 15 m to 60 m.

In some embodiments, the stone columns have a diameter of from 0.5 m to 0.75 m and are spaced apart from one another by approximately 1.5 m to 3 m from center to center of adjacent below-ground stone columns.

In some embodiments, the stone columns have a depth of from 6 m to 10 m below the above-ground structure.

In some embodiments, the stone columns have a depth of at most 31 m below the above ground structure.

In some embodiments, the non-woven geofabric is selected from a group consisting of polypropylene and polyethylene.

In some embodiments, the non-woven geofabric has an amount of polypropylene of from 60 wt. % to 70 wt. % of the geofabric and an amount of polyethylene of from 30 wt. % to 40 wt. % of the geofabric.

In some embodiments, the non-woven geofabric has a thickness of from 1 mm to 10 mm.

In some embodiments, the non-woven geofabric has a specific gravity of from 0.8 to 1.

In some embodiments, the cementing agent is ordinary cement Portland (OPC) with an amount of OPC of from 10 wt. % to 15 wt. % of the stone column.

In some embodiments, the cementing agent has a density of from 125 kg/m$^3$ to 350 kg/m$^3$.

In some embodiments, the cementing agent has an amount of lime of from 60 wt. % to 67 wt. % of the cementing agent, an amount of silica of from 17 wt. % to 25 wt. % of the cementing agent, an amount of alumina of from 3 wt. % to 8 wt. % of the cementing agent, an amount of iron oxide of from 0.5 wt. % to 0.6 wt. % of the cementing agent, a total amount of $K_2O$ and $Na_2O$ of from 0.2 wt. % to 1.5 wt. % of the cementing agent, and an amount of magnesia of from 0.1 wt. % to 1 wt. % of the cementing agent.

In some embodiments, the cementing agent has a specific gravity of from 3 to 4.

In some embodiments, the cementing agent has a Blaine's specific surface of from 2400 cm$^2$/kg to 2500 cm$^2$/kg.

In some embodiments, the plurality of below-ground stone columns has reinforcing bars, wherein the reinforcing bars have a length of 1.1-2 times an average width of the stone column. In some embodiments, the reinforcing bars are angled to form conical structures comprising an upper conical structure and a lower conical structure, wherein the upper conical structure penetrates the lower conical structure by no more than 0.5 times the height of the lower conical structure.

The foregoing general description of the illustrative present disclosure and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
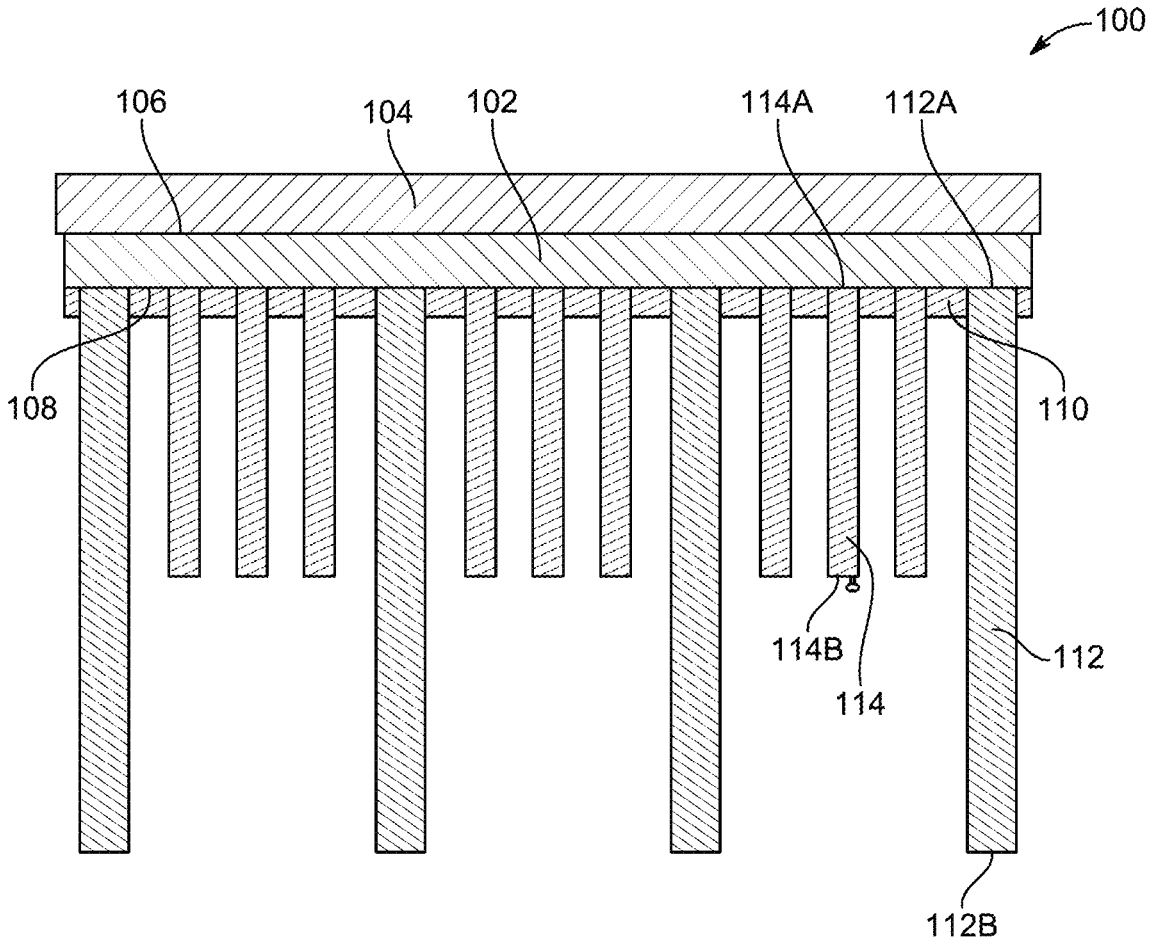
FIG. 1 is a schematic cross-sectional view of a foundation system for collapsible soils, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values there between.

Figure 2A:
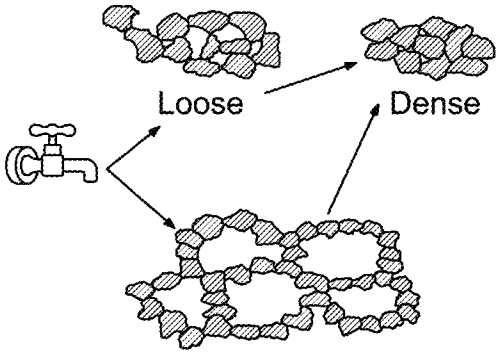
FIG. 2A is an exemplary enlarged view showing strength of the collapsible soils.

Referring to FIG. 1, a schematic cross-sectional view of a foundation system 100 is illustrated. In an embodiment, the foundation system 100 is designed and developed for collapsible soils. Referring to FIG. 2A, the collapsible soils are, generally, defined as any unsaturated soil that goes through a radical arrangement of particles and a great loss of volume upon wetting with or without additional loading. Collapsible soils can be further defined as soils which remain at a stable state in unsaturated conditions but are susceptible to appreciable volume change induced by water infiltration alone or water infiltration in combination with external loading (including self-weight) and dynamic force at full saturation or near saturation. In some embodiments, the foundation system 100 may be implemented for any other types of soils known to a person of ordinary skill in the art, such as clay, sand, silt, peat, chalk, and loam. The foundation system 100 includes a below-ground rigid raft foundation 102, alternatively referred to as 'the raft foundation 102', to bear a load for an above-ground structure 104, which is otherwise referred to as 'the building structure 104'. The raft foundation 102 is, generally, formed by reinforced concrete slabs of uniform thickness and covers entire area (footprint) of the above-ground structure 104, thereby to spread the load imposed by multiple columns and walls of the above ground structure 104 over entire area of the raft foundation 102. As used herein, the term "above-ground structure" refers any building that sits directly on top of the earth, soil, or ground, such as a residential building, commercial building, manufacturing building, infrastructure projects, barns, or other architectural buildings. In some embodiments, the base of the above-ground structure 104 is in direct contact with the rigid raft foundation 102, so that the rigid raft 102 completely encompasses the above-ground structure 104. In some embodiments, the rigid raft foundation 102 is 1.1 to 2 times greater than the entire footprint of the above-ground structure 104, preferably 1.2 to 1.9 times greater, preferably 1.3 to 1.8 times greater, preferably 1.4 to 1.7 times greater, preferably 1.5 to 1.6 times greater, or 1.55 times greater. As used herein, the term "below-ground" refers to raft being below the surrounding surface of above ground structure 104, making the raft foundation 102 buried in the ground. In some embodiments, the raft foundation 102 is from 10 inches (in) to 200 in below the above ground structure 104, preferably 20 in to 190 in, preferably 30 in to 180 in, preferably 40 in to 170 in, preferably 50 in to 160 in, preferably 60 in to 150 in, preferably 70 in to 140 in, preferably 80 in to 130 in, preferably 90 in to 120 in, preferably 100 in to 110 in, or 105 in. In some embodiments the size of the raft may be 75 m long and 75 m wide, preferably 80 m and 80 m, preferably 85 m and 85 m, preferably 90 m and 90 m, or 100 m and 100 m. The raft foundation 102 may have a uniform thickness defined between an upper surface 106 and a lower surface 108. In some embodiments, the thickness of the raft foundation 102 may be defined based on various factors including, but not limited, strength of the collapsible soils, and size of the above ground structure 104. The above ground structure 104 is formed on the upper surface 106 of the raft foundation 102. In some embodiments, the raft foundation 102 is a poured slab of with concrete, such as ordinary concrete, reinforced concrete, prestressed concrete, precast concrete, lightweight concrete, air entranced concrete, and high-density concrete. In some embodiments, the poured slab concrete of the raft foundation 102 is reinforced with carbon steel, wire mesh, fiber-reinforced plastic, wire, cross-ties, or basalt fiber The foundation system 100 further includes a plurality of granular cushions 110 formed below the raft foundation 102. More particularly, the plurality of granular cushions 110 may be disposed immediately below the lower surface 108 of the raft foundation 102. The plurality of granular cushions 110 is configured for uniform load distribution of the raft foundation 102. In certain embodiments, the granular cushions 110 are geotextile bags filled with sand, gravel, pebbles, slag, topsoil, ballast, gypsum, fill, granite dust, or other aggregated materials. In certain embodiments, the aggregated materials have a size ranging from 10 mm to 150 mm, preferably 20 mm to 140 mm, preferably 30 mm to 130 mm, preferably 40 mm to 120 mm, preferably 50 mm to 110 mm, preferably 60 mm to 100 mm, preferably 70 mm to 90 mm, or 80 mm. In certain embodiments, the granular cushions have a length of 1 m to 20 m, preferably 2 m to 19 m, preferably 3 m to 18 m, preferably 4 m to 17 m, preferably 5 m to 16 m, preferably 6 m to 15 m, preferably 7 m to 14 m, preferably 8 m to 13 m, preferably 9 m to 12 m, or preferably 10 m.

Figure 2B:
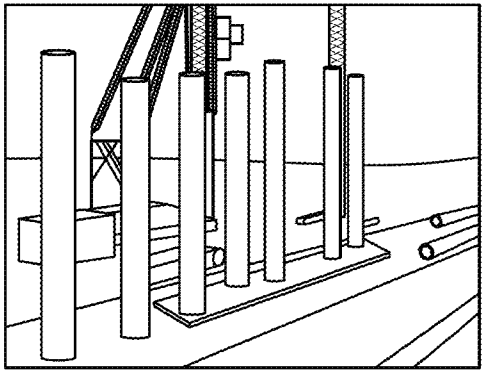
FIG. 2B is an exemplary perspective view showing multiple piles supported on a ground.

The foundation system 100 further includes a plurality of piles 112 formed below the raft foundation 102. Particularly, the plurality of piles 112 is formed immediately below the lower surface 108 of the raft foundation 102. Each of the plurality of piles 112 includes a top end 112A configured to connect with the lower surface 108 of the raft foundation 102 and a bottom end 112B. The plurality of piles 112 is configured to bear a load of the above ground structure 104 and the raft foundation 102. As shown in FIG. 2B, the piles 112 are long and slender elements used for transferring the loads of the above ground structure 104 and the raft foundation 102 to deeper rock or firm soil layers. In some embodiments, the piles 112 are made of steel or steel alloys and filled with concrete, such as ordinary concrete, reinforced concrete, prestressed concrete, precast concrete, lightweight concrete, air entranced concrete, and high-density concrete. In certain embodiments, the piles 112 may be made of metals or metal alloys known to a person of ordinary skill in the art, such as iron, aluminum, titanium, platinum, tungsten carbides, cobalt, and carbon steel. In some embodiments, the piles 112 may be cylindrical in shape. In certain embodiments, a cross-sectional shape of the pile 112 may be square, rectangular, elliptical, or any other polygon shape known in the art. In some embodiments, steel piles may be spliced by welding or riveting depending on the application. When hard driving conditions are expected, the steel piles can be fitted with driving points or shoes.

In some embodiments, the piles 112 are coated with an epoxy. As the steel piles are subjected to corrosion (pH<7), the epoxy coating on the piles helps to prevent or minimize corrosion thereof, and thereby improve useful life of the piles 112. In certain embodiments, the epoxy may be bisphenol, aliphatic, halogenated, diluents, or glycidylamine epoxies. In certain embodiments, additional thickness is provided to the piles 112 to improve useful life thereof, such as 1 m, 2 m, 3 m, 4 m, or 5 m. In some embodiments, the piles 112 have a length defined between the top end 112A and the bottom end 112B. The length of the pile 112 may be from 15 m to 60 m, preferably 20 m to 55 m, preferably 25 m to 50 m, preferably 30 m to 45 m, preferably 35 m to 40 m, or 37.5 m. Also, the pile 112 can carry a load in a range of 300 N to 1200 N, preferably 375 N to 1125 N, preferably 450 N to 1050 N, preferably 525 N to 975 N, preferably 600 N to 900 N, preferably 675 N to 825 N, or 750 N. In certain embodiments, the length of the piles 112 may be longer than 60 m depending on the application and, accordingly, load carrying capacity can be increased further, such as 65 m, 70 m, 75 m, 80 m, 85 m, 90 m, 95 m, or 100 m.

Figure 2C:
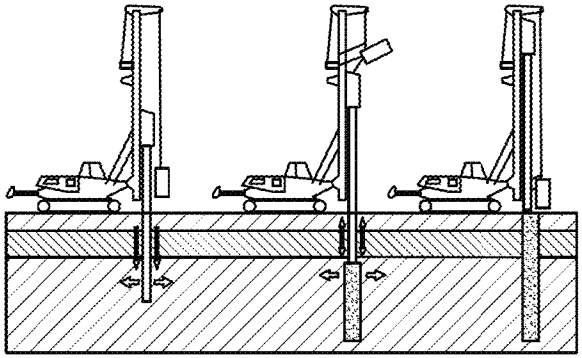
FIG. 2C is an exemplary view showing a process of forming stone columns in the ground using a vibroflot.

The foundation system 100 further includes a plurality of stone columns 114 configured to stabilize the raft foundation 102. Each of the plurality of stone columns 114 has a top end 114A connected to the lower surface 108 of the raft foundation 102 and a bottom end 114B, as such the raft foundation 102 is formed adjacent and above the stone columns 114. In certain embodiments, there are at least 3 granular cushions 110 for every 1 pile 112, preferably 3 cushions 110 for every 1 pile 112, preferably 4 cushions, preferably 5 cushions, preferably 6 cushions, preferably 7 cushions, preferably 8 cushions, preferably 9 cushions, or 10 stone cushions 110 for every pile 112. In certain embodiments, there are at least 2 stone columns 114 for every 1 pile 112, preferably 3 columns 114 for every 1 pile 112, preferably 4 columns, preferably 5 columns, preferably 6 columns, preferably 7 columns, preferably 8 columns, preferably 9 columns, or 10 stone columns 114 for every pile 112. In certain embodiments, there are at least 2 granular cushions 110 for every 1 stone column 114, preferably 4 cushions, preferably 6 cushions, preferably 8 cushions, or 10 stone cushions 110 for every stone column 114. In certain embodiments, the stone columns were coupled with supports such as steel, brick, and wood. In certain embodiments, the stone columns 114 were reinforced with concrete, carbon steel, wire mesh, fiber-reinforced plastic, wire, cross-ties, or basalt fiber. In certain embodiments, the stone columns were reinforced with a polymer filler (polyurethane), binder, or adhesive. In certain embodiments, the stone columns are reinforced with a curable polyurethane injection, a curable concrete, or other curable materials. In some embodiments, the stone columns are reinforced with a matrix of concrete, ordinary Portland cement, polyurethane, organic polymers, or inorganic matrices. In further embodiments, the reinforced matrix may include concrete, carbon steel, wire mesh, fiber-reinforced plastic, wire, cross-ties, or basalt fiber. Further, the granular cushions 110 are present between neighboring stone columns 114. Particularly, the granular cushion 110 is formed between two adjacent stone columns 114 immediately below the lower surface 108 of the raft foundation 102. Also, the granular cushions 110 are present between the stone columns 114 and the piles 112. As shown in FIG. 2C, the stone column 114 generally includes granular materials compacted in long cylindrical holes defined in the ground. In an exemplary embodiment, a vibroflot is inserted into the ground to make a circular hole that extends through the soil to firmer soil. In certain embodiments, the circular hole fitted for the stone column is reinforced with straight bars, steel wires, or the like. The cylindrical hole is further filled with a granular material like imported gravel. In certain embodiments, the cylindrical hole is filled with base gravel, stones, clay, sand, marble, river rock, pea gravel, or stone or a mixture of any two or more components. In certain embodiments, the granular material has a size that ranges from 10 to 600 mm, preferably 40 to 570 mm, preferably 70 to 540 mm, preferably 100 to 510 mm, preferably 130 to 480 mm, preferably 160 to 420 mm, preferably 160 to 450 mm, preferably 190 to 420 mm, preferably 210 to 390 mm, preferably 240 to 360 mm, preferably 270 to 330 mm, or 300 mm. In certain embodiments, the granular material has a density that ranges from 100 kg/m$^3$ to 500 kg/m$^3$, preferably 125 kg/m$^3$ to 475 kg/m$^3$, preferably 150 kg/m$^3$ to 450 kg/m$^3$, preferably 175 kg/m$^3$ to 425 kg/m$^3$, preferably 200 kg/m$^3$ to 400 kg/m$^3$, preferably 225 kg/m$^3$ to 375 kg/m$^3$, preferably 250 kg/m$^3$ to 350 kg/m$^3$, preferably 275 kg/m$^3$ to 325 kg/m$^3$, or 300 kg/m$^3$.

In certain embodiments, the rigid raft foundation 102 extends above the cylindrical hole fitted for the stone column as to allow the stone column 114 to be partially encapsulated by the rigid raft foundation. In certain embodiments, the rigid raft foundation 102 has a thickness of 0.5 m to 10 m, preferably 1 m to 9 m, preferably 2 m to 8 m, preferably 3 m to 7 m, preferably 4 m to 6 m, or 5 m. In certain embodiments, the stone columns 114 protrude into the thickness of the rigid raft foundation 102 in a range from 10 cm to 1 m, preferably 100 cm to 900 cm, preferably 200 cm to 800 cm, preferably 300 cm to 700 cm, preferably 400 cm to 600 cm, or 500 cm. In certain embodiments, the steel piles 112 protrude into the thickness of the rigid raft foundation 102 in a range from 10 cm to 1 m, preferably 100 cm to 900 cm, preferably 200 cm to 800 cm, preferably 300 cm to 700 cm, preferably 400 cm to 600 cm, or 500 cm.

In certain embodiments, the granular cushions 110 form around the cylindrical holes fitted for the stone columns 114, spanning across the entire circumference of the cylindrical hole. In certain embodiments, the granular cushions are in direct contact with the rigid raft foundation 102 and the stone columns 114 in which the granular cushions 110 surround the entire circumference of the cylindrical hole fitted for the stone columns 114 which protrude into the thickness of the rigid raft foundation 102.

The gravel in the cylindrical hole is gradually compacted as the vibrator is withdrawn. The gravel used for preparing the stone column 114 has size in a range of 10 to 400 mm, preferably 25 to 375 mm, preferably 50 to 350 mm, preferably 75 to 325 mm, preferably 100 to 300 mm, preferably 125 to 275 mm, preferably 150 to 250 mm, preferably 175 to 225 mm, or 200 mm. In certain embodiments, the stone columns 114 may have a slenderness ratio, length to diameter ratio, of 5, 10, 15, 20, 25, 40, 50, or 60. In certain embodiments, In some embodiments, each of the plurality of stone columns 114 has a diameter from 0.5 m to 0.75 m, preferably 0.525 m to 0.725 m, preferably 0.55 m to 0.7 m, preferably 0.575 m to 0.675 m, preferably 0.6 m to 0.65 m, or 0.625 m and the plurality of stone columns 114 are spaced apart from one another by approximately 1.5 m to 3 m from center to center of an adjacent stone column 114, preferably 1.6 m to 2.9 m, preferably 1.7 m to 2.8 m, preferably 1.8 m to 2.7 m, preferably 1.9 m to 2.6 m, preferably 2 m to 2.5 m, preferably 2.1 m to 2.4 m, preferably 2.2 m to 2.3 m, or 2.25 m. In other words, a center to center distance between two adjacent stone columns 114 is in the range of 1.5 m to 3 m. In some embodiments, the spacing between the stone columns 114 and the piles 112 is 1 to 2 m, preferably 1.1 to 1.9 m, preferably 1.2 to 1.8 m, preferably 1.3 to 1.7 m, preferably 1.4 to 1.6 m, or 1.5 m. In some embodiments, each of the plurality of stone columns 114 has a depth from 6 m to 10 m below the above ground structure 104, preferably 6.5 m to 9.5 m, preferably 7 m to 9 m, preferably 7.5 m to 8.5 m, or 8 m. Particularly, a length of the stone column 114 defined between the top end 114A and the bottom end 114B is in a range of 6 m to 10 m, preferably 6.5 m to 9.5 m, preferably 7 m to 9 m, preferably 7.5 m to 8.5 m, or 8 m. In some embodiments, each of the plurality of stone columns 114 has a depth of at most 31 m below the above ground structure 104 depending on the application of the foundation system 100, and may be increased further such as 32 m, 33 m, 34 m, 35 m, 36 m, 37 m, 38 m, 39 m, or 40 m.

In certain embodiments, the stone in the stone columns is marble, limestone, sandstone, granite, gneiss, basalt, trap, slate, quartzite, laterite, murum, or a mixture of any two or more components. In certain embodiments, the stone has a size that ranges from 10 to 500 mm, preferably 35 to 575 mm, preferably 60 to 550 mm, preferably 85 to 525 mm, preferably 110 to 500 mm, preferably 135 to 420 mm, preferably 160 to 450 mm, preferably 185 to 425 mm, preferably 210 to 400 mm, preferably 235 to 375 mm, preferably 260 to 325 mm, preferably 285 to 300 mm, or 290 mm. In certain embodiments, the stone has a density that ranges from 100 kg/m$^3$ to 500 kg/m$^3$, preferably 125 kg/m$^3$ to 475 kg/m$^3$, preferably 150 kg/m$^3$ to 450 kg/m$^3$, preferably 175 kg/m$^3$ to 425 kg/m$^3$, preferably 200 kg/m$^3$ to 400 kg/m$^3$, preferably 225 kg/m$^3$ to 375 kg/m$^3$, preferably 250 kg/m$^3$ to 350 kg/m$^3$, preferably 275 kg/m$^3$ to 325 kg/m$^3$, or 300 kg/m$^3$.

In a preferable embodiment of the invention one or more of the stone columns, and preferably all of the stone columns 114, contain a series of tiered angled reinforcing bars. Each reinforcing bar has a length of 1.1-2 times the average width of the stone column, preferably 1.2-1.9 times the average width of the stone column, preferably 1.3-1.8 times the average width of the stone column preferably 1.4-1.7 times the average width of the stone column, preferably 1.5-1.6 times the average width of the stone column, or 1.55 times the average width of the stone column. The angled reinforcing bars are arranged circumferentially in the stone column such that a top end of each angled reinforcing bar is at an outer most portion of the stone column. The angled reinforcing bar is angled such that a bottom end of the reinforcing bar is close to the long central axis of the stone column. Preferably the bottom end of the reinforcing bar is located within a distance of 0.1 times the average width of the stone column from the central axis of the stone column. The number of angled reinforcing bars per tier (stage) may vary. Preferably the density of the angled reinforcing bars is set such that there is one reinforcing bar for each 0.1-0.5 times a distance of the circumference of the stone column preferably each 0.2-0.3 times a distance of the circumference of the stone column, or 0.25 times a distance of the circumference of the stone column. Arranged in this way each tier of angled reinforcing bars may be viewed as an inverted conical structure. The conical structures are nested such that an upper conical structure penetrates a lower conical structure by no more than 0.5 times the height of the lower conical structure, preferably, 0.2-0.4 times the height of the lower conical structure, or 0.3 times the height of the lower conical structure. The tiered conical structures may begin at the bottom of the stone column repeating to the top of the stone column. Reinforcing bars may be placed during the assembly of the stone column and activation of the cementing agent. The inclusion of tiers of reinforcing bars aids in halting lateral displacement of the foundation system during seismic events.

Figure 2D:
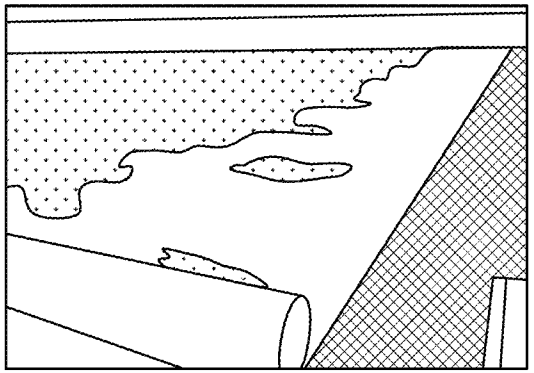
FIG. 2D is an exemplary view showing a non-woven geofabric laid on the ground.

In some embodiments, the plurality of stone columns 114 is encapsulated with a non-woven geofabric. In an example, the non-woven geofabric material used in the present disclosure is Terram 3000 (T3000). Typically, referring to FIG. 2D, the Terram geofabric is used in ground stabilization to enhance performance and design life of granular layers by providing the filtration and separation function. In various examples, other known types of non-woven geofabric suitable for the foundation system 100 of the present disclosure may be used without departing from the scope of the present disclosure, such as any geotextile comprising a polyolefin, polyester, or polyamide polymer. The geofabric material may be available in different types based on various material characteristics and applications such as lightweight, thermal bonding, non-woven, permeable materials designed for use in ground stabilization, drainage, reinforcement, and erosion control to special purpose fabrics.

In some embodiments, the non-woven geofabric is selected from a group consisting of polypropylene and polyethylene. In some embodiments, the non-woven geofabric has an amount of polypropylene from 60 wt. % to 70 wt. % of the geofabric, preferably 61 wt. % to 69 wt. %, preferably 62 wt. % to 68 wt. %, preferably 63 wt. % to 67 wt. %, preferably 64 wt. % to 66 wt. %, or 65 wt. % and an amount of polyethylene from 30 wt. % to 40 wt. % of the geofabric, preferably 31 wt. % to 39 wt. %, preferably 32 wt. % to 38 wt. %, preferably 33 wt. % to 37 wt. %, preferably 34 wt. % to 36 wt. %, or 35 wt. %. In an example, the Terram geofabric is made from 67% polypropylene and 33% polyethylene. In some embodiments, the non-woven geofabric has a thickness from 1 mm to 10 mm, preferably 2 mm to 9 mm, preferably 3 mm to 8 mm, preferably 4 mm to 7 mm, preferably 5 mm to 6 mm, or 6.5 mm and a specific gravity from 0.8 to 1, preferably 0.82 to 0.98, preferably 0.84 to 0.96, preferably 0.86 to 0.94, preferably 0.88 to 0.92, or 0.9. In an example, the Terram geofabric has 1.0 mm thickness and the specific gravity is 0.9. The structural characteristics of Terram geofabric are: a maximum load (per 200 mm) is 2800 N, preferably 2810 N, preferably 2820 N, preferably 2830 N, preferably 2840 N, or 2850 N and extension at maximum load is 60%, preferably 61%, preferably 62%, preferably 63%, preferably 64%, or 65%. Further, Terram is resistant to all naturally occurring soil alkalis—even 10% sodium hydroxide has little effect. Terram geofabric has resistance to all naturally occurring soil acids—(i.e., to acids of pH>2), and to general chemical attack, for example, water, oil, and petrol.

Figure 2E:
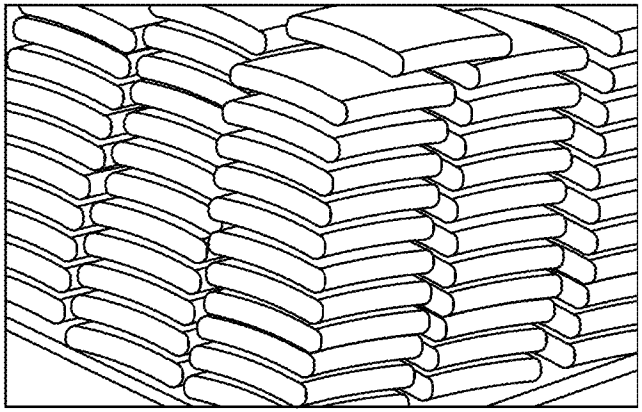
FIG. 2E is an exemplary view showing stacked packets of cementing agents.

In some embodiments, each of the plurality of stone columns 114 has a cementing agent. The cementing agent is employed to stabilize the stone columns 114. In certain embodiments, the cementing agent may be a calcite, aragonite, dolomite, siderite, silicate, sulfate, or chloride. Referring to FIG. 2E, the cementing agent has a density from 125 kg/m$^3$ to 350 kg/m$^3$, preferably 150 kg/m$^3$ to 325 kg/m$^3$, preferably 175 kg/m$^3$ to 300 kg/m$^3$, preferably 200 kg/m$^3$ to 275 kg/m$^3$, preferably 225 kg/m$^3$ to 250 kg/m$^3$, or 240 kg/m$^3$. In some embodiments, the cementing agent is Ordinary Cement Portland (OPC) with an amount of OPC from 10 wt. % to 15 wt. %, preferably 10.5 wt. % to 14.5 wt. %, preferably 11 wt. % to 14 wt. %, preferably 11.5 wt. % to 13.5 wt. %, preferably 12 wt. % to 13 wt. %, or 12.5 wt. % of the stone column. In certain embodiments, the amount of OPC may be 12 wt. % of the stone column 114 and the corresponding density may be 234 kg/m$^3$. In some embodiments, the cementing agent has an amount of lime (CaO) from 60 wt. % to 67 wt. % of the cementing agent, preferably 61 wt. % to 66 wt. %, preferably 62 wt. % to 65 wt. %, preferably 63 wt. % to 64 wt. %, or 63.5 wt. %; an amount of silica ($SiO_2$) from 17 wt. % to 25 wt. % of the cementing agent, preferably 18 wt. % to 24 wt. %, preferably 19 wt. % to 23 wt. %, preferably 20 wt. % to 22 wt. %, or 21 wt. %; an amount of alumina ($Al_2O_3$) from 3 wt. % to 8 wt. % of the cementing agent, preferably 3.5 wt. % to 7.5 wt. %, preferably 4 wt. % to 7 wt. %, preferably 4.5 wt. % to 6.5 wt. %, preferably 5 wt. % to 6 wt. %, or 5.5 wt. %; an amount of iron oxide from 0.5 wt. % to 0.6 wt. % of the cementing agent, preferably 0.51 wt. % to 0.59 wt. %, preferably 0.52 wt. % to 0.58 wt. %, preferably 0.53 wt. % to 0.57 wt. %, preferably 0.54 wt. % to 0.56 wt. %, or 0.55 wt. %; an amount of alkalies ($K_2O$ and $Na_2O$) from 0.2 wt. % to 1.5 wt. % of the cementing agent, preferably 0.3 wt. % to 1.4 wt. %, preferably 0.4 wt. % to 1.3 wt. %, preferably 0.5 wt. % to 1.2 wt. %, preferably 0.6 wt. % to 1.1 wt. %, preferably 0.7 wt. % to 1 wt. %, preferably 0.8 wt. % to 0.9 wt. %, or 0.85 wt. %; and an amount of magnesia from 0.1 wt. % to 1 wt. % of the cementing agent, preferably 0.2 wt. % to 0.9 wt. %, preferably 0.3 wt. % to 0.8 wt. %, preferably 0.4 wt. % to 0.7 wt. %, preferably 0.5 wt. % to 0.6 wt. %, or 0.55 wt. %.

In some embodiments, the cementing agent has a specific gravity from 3 to 4 preferably 3.1 to 3.9, preferably 3.2 to 3.8, preferably 3.3 to 3.7, preferably 3.4 to 3.6, or 3.5; and a Blaine's specific surface from 2400 cm$^2$/kg to 2500 cm$^2$/kg, preferably 2410 cm$^2$/kg to 2490 cm$^2$/kg, preferably 2420 cm$^2$/kg to 2480 cm$^2$/kg, preferably 2430 cm$^2$/kg to 2470 cm$^2$/kg, preferably 2440 cm$^2$/kg to 2460 cm$^2$/kg, or 2450 cm$^2$/kg. Particularly, specific gravity and the Blaine's specific surface of the OPC are 3.15, 24 and 2415 cm$^2$/kg, respectively. Also, physical properties such as initial setting time and final setting time of the OPC are 1 hour and 10 hours, respectively. In some embodiments, the initial setting time and final setting time are 2 hours and 11 hours, or 3 hours and 12 hours, or 4 hours and 13 hours, or 5 hours and 14 hours.

Figure 3:
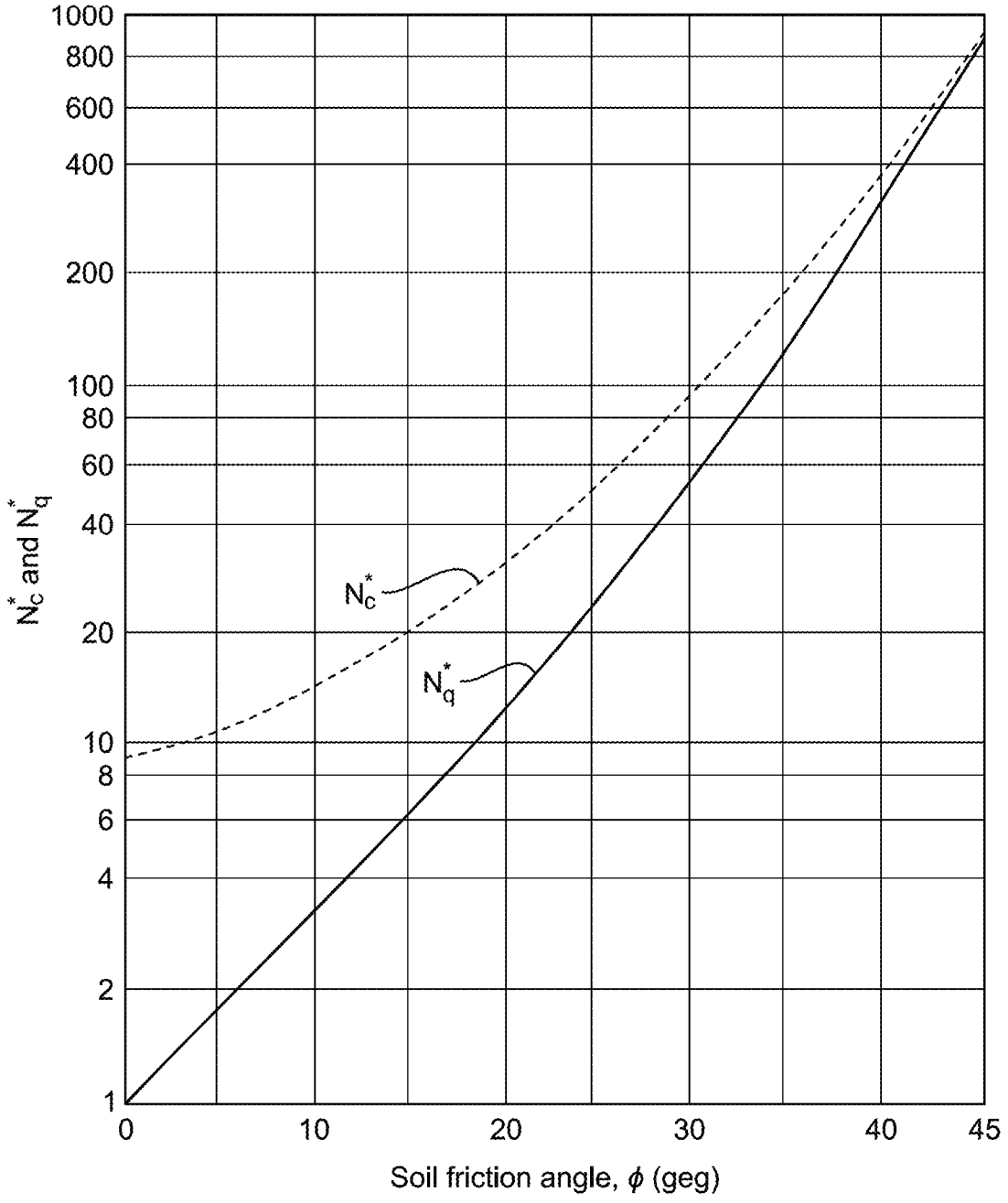
FIG. 3 is a Meyerhof chart used for determining bearing capacity factors, according to certain embodiments.

According to the present disclosure, an analytical model is developed for predicting the load carrying capacity ($Q_g$su>) of the foundation system 100. The analytical model is developed based on various factors such as dimensional characteristics of the piles 112 and the stone columns 114, total number of the piles 112 and the stone columns 114 in the foundation system 100, number of the piles 112 and the stone columns 114 in each row and columns of the foundation system 100, physical properties of the collapsible soils, and bearing capacity factor deduced from a Meyerhof chart, as shown in FIG. 3.

The analytical model is $$Q_{g(u)} = \left[\frac{2(n_1+n_2-2)S+4D_p}{\pi n_1 n_2 D_p}\right]$$
$$\left[n\left(\frac{\pi}{4}D_p^2\gamma' L_p N_q^* + \pi D_p L_p(1-\sin\varphi_s)\tan\left(\frac{2}{3}\varphi_s\right)\gamma'\frac{L_p^2}{2}\right)\right.$$
$$\left.+m\left(\frac{\pi}{4}D_c^2\right)\left(\frac{2c\cos\varphi_c}{1-\sin\varphi_c}+\frac{2\sin\varphi_c}{1-\sin\varphi_c}(1-\sin\varphi_s)(3\gamma' D_c+\gamma' L_c)\right)\right]$$

Wherein:

$D_p$=Diameter of the pile tip $D_c$=Diameter of stone column $L_p$=Length of pile tip $L_c$=Length of stone column n=Number of piles in the foundation system m=Number of stone columns in the foundation system S=Minimum spacing between piles and/or columns $n_1$=Number of piles and columns in one row $n_2$=Number of piles and columns in one column $\gamma'$=Effective unit weight of collapsible soil c=Cohesion of stabilized stone column $\varphi_s$=Angle of shearing resistance of collapsible soil $\varphi_s$=Angle of shearing resistance of stabilized stone column $N^*_q$=Bearing capacity factor According to the present disclosure, the foundation system 100 is preferred for collapsible soils. The foundation system 100 includes the rigid raft foundation 102, the cylindrical steel piles 112, and the encapsulated and stabilized stone columns 114 combined in one foundation support for supporting the collapsible soils. Enough stone columns 114 are provided in the foundation system 100 to accelerate the rate of consolidation of the soil foundation. Soil consolidation refers to the mechanical process by which soil changes volume gradually in response to a change in pressure. The foundation system 100 of the present disclosure has improved carrying capacity and helps to modify soil foundation to a new upgraded composite ground. Further, the foundation system 100 of the present disclosure helps to reduce cost of geotechnical works. The analytical model of the present disclosure helps to predict carrying capacity of the foundation system 100.

Obviously, numerous modifications and variations of the present disclosure are possible in light of the above teachings. It is therefore to be understood that within the scope of the appended claims, the invention may be practiced otherwise than as specifically described herein.

The invention claimed is:

1. A geofabric foundation system for collapsible soils, comprising:

a below-ground rigid raft foundation to bear a load for an above-ground structure;

a plurality of granular cushions in the form of bags disposed below the below-ground rigid raft foundation wherein the granular cushions are configured for uniform load distribution of the below-ground rigid raft foundation and have a length of 8 to 20 m;

a plurality of piles formed below the raft foundation, wherein the plurality of piles is configured to bear a load of the above-ground structure and the below-ground rigid raft foundation, wherein the piles have a square cross-sectional shape; and a plurality of below-ground stone columns configured to stabilize the below-ground rigid raft foundation wherein the below-ground stone columns are encapsulated with a non-woven geofabric;

wherein the below-ground raft foundation is adjacent and above the below-ground stone columns, the granular cushions are present between neighboring below-ground stone columns, and the granular cushions are present between the below-ground stone columns and the piles;

wherein the below-ground stone columns have a cementing agent for stabilization;

wherein the plurality of below-ground stone columns has reinforcing bars, wherein the reinforcing bars have a length of 1.1-2 times an average width of the stone column; and wherein the reinforcing bars are angled to form a plurality of tiers of conical structures arranged in nested form wherein an upper conical structure and a lower conical structure are disposed such that the upper conical structure penetrates the lower conical structure by no more than 0.5 times the height of the lower conical structure.

2. The system of claim 1, wherein the piles are steel and filled with a concrete.

3. The system of claim 1, wherein the piles are coated with an epoxy.

4. The system of claim 1, wherein the piles have a length of from 15 m to 60 m.

5. The system of claim 1, wherein the below-ground stone columns have a diameter of from 0.5 m to 0.75 m and are spaced apart from one another by 1.5 m to 3 m from center to center of adjacent below-ground stone columns.

6. The system of claim 1, wherein the below-ground stone columns have a depth of from 6 m to 10 m below the above-ground structure.

7. The system of claim 1, wherein the below-ground stone columns have a depth of at most 31 m below the above-ground structure.

8. The system of claim 1, wherein the non-woven geofabric is selected from a group consisting of polypropylene and polyethylene.

9. The system of claim 8, wherein the non-woven geofabric has an amount of polypropylene of from 60 wt. % to 70 wt. % of the geofabric and an amount of polyethylene of from 30 wt. % to 40 wt. % of the geofabric.

10. The system of claim 1, wherein the non-woven geofabric has a thickness of from 1 mm to 10 mm.

11. The system of claim 1, wherein the non-woven geofabric has a specific gravity of from 0.8 to 1.

12. The system of claim 1, wherein the cementing agent is ordinary cement Portland (OPC) with an amount of OPC of from 10 wt. % to 15 wt. % of the total weight of the stone column.

13. The system of claim 1, wherein the cementing agent has a density of from 125 $kg/m^3$ to 350 $kg/m^3$.

14. The system of claim 1, wherein the cementing agent comprises:

an amount of lime of from 60 wt. % to 67 wt. % of the cementing agent, an amount of silica of from 17 wt. % to 25 wt. % of the cementing agent, an amount of alumina of from 3 wt. % to 8 wt. % of the cementing agent, an amount of iron oxide of from 0.5 wt. % to 0.6 wt. % of the cementing agent, a total amount of $K_2O$ and $Na_2O$ of from 0.2 wt. % to 1.5 wt. % of the cementing agent, and an amount of magnesia of from 0.1 wt. % to 1 wt. % of the cementing agent.

15. The system of claim 1, wherein the cementing agent has a specific gravity of from 3 to 4.

16. The system of claim 1, wherein the cementing agent has a Blaine's specific surface of from 2400 $cm^2/kg$ to 2500 $cm^2/kg$.

* * * * *